United States Patent [19]

Kürvers et al.

[11] 4,120,613

[45] Oct. 17, 1978

[54] PUMP FOR MOLTEN LEAD, PARTICULARLY INJECTION PUMP USED IN THE MANUFACTURE OF STORAGE BATTERY PLATES

[75] Inventors: Kurt Kürvers; Johann König, both of Büddingen, Fed. Rep. of Germany

[73] Assignee: Accumulatorenfabrik Sonnenschein GmbH, Büddingen, Fed. Rep. of Germany

[21] Appl. No.: 762,327

[22] Filed: Jan. 25, 1977

[51] Int. Cl.[2] ..... F04B 39/10; F04B 39/12; C21D 1/06

[52] U.S. Cl. ..... 417/53; 417/490; 164/97; 164/312

[58] Field of Search ..... 148/15.5, 16.6, 27; 417/490, 506, DIG. 1, 53; 164/97, 313; 29/156.4 WL

[56] References Cited

U.S. PATENT DOCUMENTS

| | | | |
|---|---|---|---|
| 1,133,270 | 3/1915 | Dale | 417/506 |
| 2,145,553 | 1/1939 | Morin | 417/490 |
| 3,022,204 | 2/1962 | Muller | 148/27 |
| 3,093,087 | 6/1963 | Hansen | 417/DIG. 1 |
| 3,208,885 | 9/1965 | Muller | 148/15.5 |
| 3,211,108 | 10/1965 | Mandorf, Jr. et al. | 417/490 |
| 3,469,621 | 9/1969 | Fulgenal | 417/490 |
| 3,652,073 | 3/1972 | Lewis | 164/312 |
| 3,744,548 | 7/1973 | Ikoda et al. | 164/97 |
| 3,827,920 | 8/1974 | Shimoda et al. | 148/15.5 |
| 3,903,951 | 9/1975 | Kanodo | 29/156.4 WL |
| 4,042,427 | 8/1977 | Razim et al. | 148/15.5 |

*Primary Examiner*—William L. Freeh
*Attorney, Agent, or Firm*—Flynn & Frishauf

[57] ABSTRACT

To prevent the formation of deposits of lead dross and the like due to oxidation of the molten lead, at least a portion of elements defining the pump chamber, for example the cylinder, and the piston are made as an iron casting which has been subjected to a salt bath nitriding treatment to produce a hard surface layer with excellent resistance against the deposition of lead dross.

15 Claims, 1 Drawing Figure

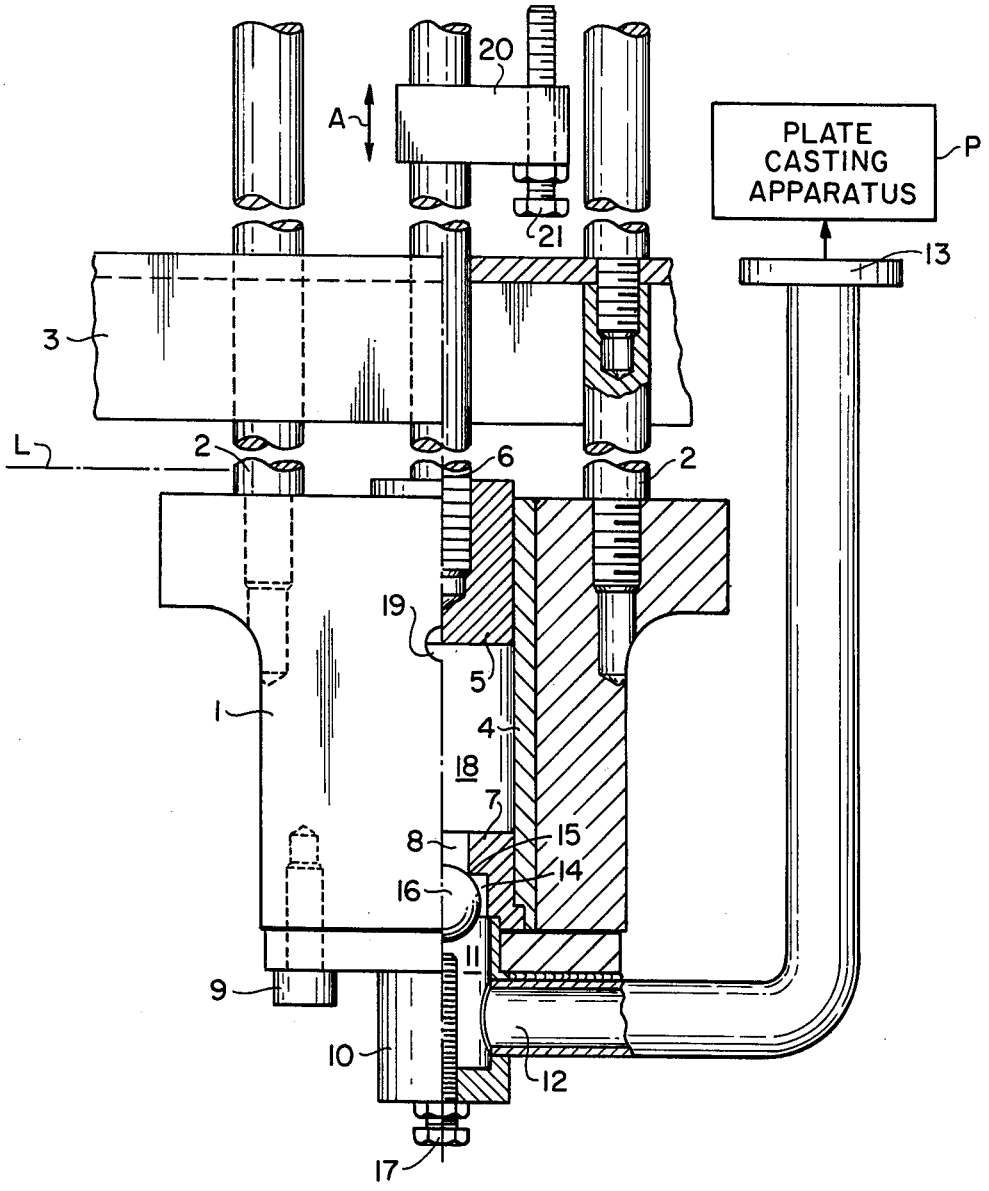
PLATE
CASTING
APPARATUS
P
A
20
21
13
3
L
2
6
2
19
5
1
4
18
7
8
15
14
16
11
9
10
12
17

PUMP FOR MOLTEN LEAD, PARTICULARLY INJECTION PUMP USED IN THE MANUFACTURE OF STORAGE BATTERY PLATES

The present invention relates to the art of lead casting and more particularly to a pump for molten lead for use in pumping molten lead to a battery plate casting apparatus.

When casting the battery plates for lead-acid batteries, pumps are used to supply liquid lead from a melt to the casting machine. As used herein, the term "lead" is deemed to include lead alloys which, in molten state, essentially have the characteristics of molten lead.

Due to the high affinity to oxidation, liquid, molten lead continuously forms lead oxide which is apt to deposit in the form of dross or similar deposits on the walls of the apparatus used to conduct the liquid lead. The deposits, typically the dross, form a hard crust. Pumps and valves, particularly, used to supply the molten lead and to properly proportion the supply of lead are subject to malfunction and require frequent maintenance, since even short operating time causes such lead deposits to build up at the walls and those portions which contact the molten lead. These deposits interfere with the operation of movalbe parts, and particularly the operation of valve elements. The pumps and valves used in the supply of molten lead thus must be cleaned frequently in order to insure proper operation. Each cleaning requires time consuming disassembly and reassembly of the apparatus which, additionally, involves high labor content and shutdown of the lead injection system.

It is an object of the present invention to improve the supply and conduction of molten lead (and this includes lead alloys), especially in connection with the manufacture of storage battery plates which is less likely, and preferably immune to deposits of lead dross and the like and thus requires less maintenance and is less subject to malfunction.

SUBJECT MATTER OF THE PRESENT INVENTION

Briefly, the parts subject to contact with molten lead, typically a pump element, a pump chamber, valve seat and the like are made in accordance with the invention of iron castings which have been subjected to a salt bath nitriding treatment to produce a surface layer comprising iron nitrides and iron carbides and having a thickness of at least 0.2 μm. Preferably, the castings consist of cast iron with lamellar graphite. Flake graphite iron castings which have a ferritic-perlitic matrix structure are preferred. It is particularly preferable to use castings which have been made in a high pressure permanent mold casting process. Iron castings with lamellar graphite and, if desired, ferritic-perlitic matrix structure, are commercial products and can be manufactured in accordance with standard processes. A particularly suitable casting comprises about 3.2% C, 2.8% Si, 0.8% Mn, 0.3% P, 0.1% S, remainder iron.

The salt bath nitriding treatment of the casting is preferably carried out in a bath comprising molten alkalicyanide and alkalicyanate at a temperature of from 500° to 600° C. for at least ½ hour. A particularly preferred bath consists of from 30 to 60% by weight alkalicyanide and from 20 to 40% by weight alkalicyanate, remainder alkalicarbonate. A suitable bath temperature is 570° C. A treatment time of 90 minutes at a bath temperature of about 570° C. provides on the iron casting a nitride layer comprising substantially iron nitride and iron carbide and having a thickness of 0.3 μm. If desired, the thickness of the nitrided surface layer may be increased by increasing the nitriding time up to 2 hours. A nitrided surface layer with a thickness of about 0.3 μm is preferred for economical reasons.

In accordance with the invention it has been found, surprisingly, that the surface of salt bath nitrided castings of cast iron has excellent resistance against deposition of lead dross, or the formation of scabs or other lead deposit. Making a pump with the elements defining the pump chamber—typically the piston and cylinder wall—of the material results in apparatus which is essentially immune to malfunction and which operates for long periods of time without maintenance or cleaning. The pump is thus particularly suitable to supply molten lead in a battery plate casting machine, in which exactly measured amounts must be supplied to the machine in order to effect economical operation thereof.

DRAWING

The single drawing is a partly schematic partly sectional elevational view of a lead injection pump to pump molten lead through a plate casting machine, and incorporating the present invention.

The pump is a piston pump which can be constructed as a submersible pump, located within the melt of molten lead, or a molten lead alloy. The pump housing 1 is suspended by means of bolts 2 on a crossbeam 3 located above the melt tank, or vessel, so that the housing of the pump is submerged, at least in part, beneath the level of the bath or melt of molten lead.

A cylinder sleeve or liner 4 is located within housing 1. Piston 5 is slidable within the cylinder sleeve 4. Piston 5 is reciprocated upwardly and downwardly—with respect to the FIGURE—in the cylinder sleeve 4 by a drive—not shown, preferably powered pneumatically or hydraulically, and which is connected with the piston 5 by means of piston rod 6.

The lower end of the cylinder sleeve 4 engages a valve ring 7 of the outlet valve for the pump. Valve ring 7 is formed with a central outlet duct 8. The lower end face of the pump housing 1 is secured to the valve head 10 by means of screws 9. The valve head 10 is formed with a cylindrical valve chamber 11 which terminates in an outlet duct 8 from which an outlet line 12 branches off. Outlet line 12 is connected to the plate casting machine shown schematically at P. Outlet line 12 laterally branches off from duct 8 and is connected to the plate casting apparatus P by a connecting flange 13, located approximately at the level of the cross brace or support 3.

The outlet valve ring 7 is formed with a recess 14 concentric with the outlet duct 8. The diameter of the recess 14 is roughly the same as the diameter of the valve chamber 11. The edge formed at the intersection of the surface defining the recess 14 with the side surface of the cylindrical outlet duct 8 forms a narrow ring-shaped valve seat 15. A ball-shaped valve body 16, having a diameter roughly ⅛ larger than the diameter of the outlet duct 8 is located in the valve chamber 11 to form the valve element. The stroke, or opening space which valve ball 16 can make between seating against the valve seat 15 and a depressed or open position is adjustable by an adjustment screw 17 against which the valve ball 16 can bear when dropped, that is, when the valve is open. Adjustment screw 17 is concentric with the outlet duct 8 and passes through a suitably tapped hole in the bottom wall of the valve element 10. The bolt 17 forms an abutment surface at the end face projecting towards the valve ball 16 to limit the stroke of the valve ball 16 during opening and closing movement thereof.

The pump chamber 18 is defined by the cylinder line 4 and the lower face of the piston 5 as well as the outlet valve ring 7. An inlet duct 19 terminates in the pump chamber. Inlet duct 19 extends transversely to the axis of the cylinder, inwardly through the pump housing 1. The piston 5, during its upward stroke, frees the opening of the inlet duct 19 when piston 5 is moved towards its upper dead center position.

A laterally projecting arm 20 is secured to the piston rod 6, located above the cross brace or support 3. The arm 20 has an abutment bolt 21 screwed in its free end in order to provide a stroke limiting adjustment. When the piston is pressed downwardly by the drive (not shown), in its reciprocating movement as schematically indicated by the double arrow A, bolt 21 will engage the cross brace 3, thus determining the lower dead center position of the piston and hence the quantity of material supplied by the pump in its pressure stroke.

Operation: The pump is submerged in the melt, at least in part, and to such an extent that the inlet opening 19 is below the level of the melt, schematically indicated for one installation by L. In a preferred form, the pump is completely submerged within the melt. When the piston 5 is in its upper dead center (UDC) position, molten lead flows through the inlet opening 19 into the pump chamber 18 to completely fill the pump chamber. Upon the subsequent compression stroke, piston 5 is moved downwardly in the direction of the arrow A by the drive, not shown, which first closes off inlet duct 19 by the downwardly moving piston to then place the material within the pump chamber 18 under pressure. The valve ball 16, previously located against the valve seat 15 is lifted off the valve seat, by being pressed downwardly by the molten material, now under pressure as the piston is forced in a downward direction. Upon further continuation of the pressure stroke, the molten material is pressed from the pump chamber 18 through the outlet duct 8 and valve chamber 11 into the outlet line 12. When the piston 5, after having carried out its pressure stroke, has reached its lower dead center (LDC) position and reverses to move upwardly, the pressure will drop in the pump chamber and, due to the pressure difference in the outlet duct, and line, and the pressure within the pump chamber, the valve ball 16 is sucked upwardly against the valve seat so that during the subsequent suction stroke, no additional molten lead can blow back from the valve chamber into the pump space. As the piston moves upwardly towards the UDC position, it will free the inlet duct 19 to permit molten lead to flow into the pump chamber, which is now under an underpressure, or vacuum, to rapidly fill the pump chamber. Upon reversing of operation, that is, as the piston again moves from the UDC toward the LDC position the quantity of molten material supplied to the outlet line per stroke can readily be adjusted by properly adjusting the pressure stroke. This adjustment is easily effected by adjustment of the abutment bolt 21 with respect to the cross brace 3.

In accordance with the primary feature of the invention, the elements defining the pumping chamber, namely the cylinder liner 4, the piston 5 and primarily the end face of the piston 5, and the outlet valve ring 7 are made of cast iron and are subjected to a salt bath nitriding treatment. The result of the nitriding treatment will be a nitrided surface layer comprising iron nitrides and iron carbides which has an excellent resistance against the deposit of impurities, particularly dross, present in molten lead or lead alloys. The surface layer should penetrate into the casting for at least about 0.2 μm, preferably 0.3 μm, to retain the good resistance against deposits over long operation times. The thickness of the nitrided surface layer depends on the nitriding time and, therefore, can be controlled by appropriate adjusting the time during which the casting is hold in nitriding salt bath. The nitriding salt bath contains alkalicyanate and alkalicyanide and is held in molten state by heating above its melting temperature. A preferred nitriding bath is composed of from 30 to 60% by weight of sodium or potassium cyanide and from 20 to 40% by weight sodium or potassium cyanate, balance substantially sodium or potassium carbonate. Such composition is heated to a temperature in the range of from 500° to 600° C., preferably 570° C., to provide a nitriding bath with good fluidity.

The iron castings are placed into the molten bath for at least ½ hour, preferably 90 minutes, to produce a nitrided surface layer penetrating into the casting for at least 0.2 μm, preferably 0.3 μm and above.

Very good results are achieved with iron castings with lamellar graphite structure and preferably with a ferritic-perlitic matrix structure. Such castings are preferably made by high pressure permanent mold casting or high pressure die-casting.

The nitriding treatment of the castings is preferably effected as follows:

Example

A bath comprising including 43% by weight sodium cyanide, 32% by weight potassium cyanate, balance sodium carbonate, is heated to a temperature of about 570° C., and the castings are placed into the melt for about 90 minutes while the melt is maintained at the temperature of about 570° C. The castings are then removed from the bath and allowed to cool in air to room temperature. It is preferred to continuously aerate the molten bath to achieve optimum results.

In accordance with a feature of the invention, the cast iron to make the castings comprises, preferably, about 3.2% C., 2.8% Si, 0.8% Mn, 0.3% P, 0.1% S, remainder iron. The surface of the castings of the above composition nitrided as set forth in the example have excellent resistance against the deposit of oxides, lead slag, dross, and the like which arise when handling molten lead, or lead alloys. Even during long term operation, the surfaces of the castings which come in contact with the molten lead, or lead alloys do not have crusts, scales, scabs, dross or other deposits adhered thereto due to contact with the molten lead.

The valve ball 16 preferably comprises a steel which has the following composition: 1.0% C, 0.25% Si, 0.35% Mn, a maximum of 0.03% P, 0.025% S and 1.55% Cr, remainder iron. Preferably, the opening stroke of the valve ball 16 is limited to a valve which is approximately half of the difference between the diameter of the valve chamber and the diameter of the valve element, or valve ball itself. This results in flow conditions within the region of the valve seat and the valve ball during the pressure stroke of the pump which effectively prevent the formation of dross, scale, or other lead or lead alloy deposits on the valve seat 15 and on the valve element, or ball 16.

Forming the cast iron elements of the composition above referred to in the example in a high pressure mold injection casting process results in particularly high density of the structure of the cast elements. The integration of the pump and the valve seat, and particularly the formation of the valve element as a ball permits construction of a pump and valve chamber which is simple to make and can be made of the material above referred to. The valve seat itself can be narrow, thus not subject to encrustation by lead deposits and, in cooperation with a valve ball, provides at all times reliable seating of the valve ball against the valve seat, and hence reliable sealing of the valve during the suction stroke of the pump, so that the subsequent compression stroke will supply an accurately measured predetermined quantity of lead to the plate casting machine P through the outlet line 12. Additionally, it is simple to adjust the stroke of the valve ball 16 to thereby optimize the flow conditions of the liquid lead as it is pressed to the outlet line 12 during the compression stroke of the pump. Upon the compression stroke, the liquid lead flows at high speed through the valve chamber so that neither the valve chamber, nor the valve body, or ball 16 itself is subject to encrustation by lead, or lead slag or dross.

Various changes and modifications may be made within the scope of the inventive concept.

What is claimed is:

1. Pump for molten lead having a housing structure element (1, 4) defining at least a portion of a pump chamber (18);

means (19) introducing molten lead into the pump chamber;

and a pump element (5) located in the housing structure element (1, 4) forming a surface defining the pump chamber wherein, in accordance with the invention at least one of said elements (1, 4; 5) defining at least a portion of the surface of the pump chamber (18) comprises a casting of cast iron which was nitrided in a molten salt nitriding bath.

2. A pump according to claim 1 wherein at least one of the elements comprises a high pressure permanent mold casting of about 3.2% C, 2.8% Si, 0.8% P, 0.1% S, remainder iron.

3. A pump according to claim 1 wherein the casting consists of cast iron with lamellar graphite.

4. A pump according to claim 3 wherein the casting has a ferritic-perlitic matrix structure.

5. A pump according to claim 1 wherein the nitriding within the molten bath is carried out for a time sufficient to produce a surface layer substantially consisting of iron nitrides and iron carbides and having a thickness of at least 0.2 $\mu$m.

6. A pump according to claim 5 wherein said surface layer is the product of nitriding in a cyanide-cyanate-melt at temperature in the range from 500° to 600° C. for at least ½ hour.

7. A pump according to claim 6 wherein said surface layer is the product of nitriding in a salt melt bath comprising from 30 to 60% by weight alkalicyanide, remainder alkalicarbonate, for about 90 minutes at a bath temperature of about 570° C.

8. A pump according to claim 1 wherein the housing structure defining at least a portion of the pump chamber (18) comprises a cylinder liner (4) and an outlet valve portion (7), said outlet valve portion being shaped to form an outlet valve seat (15);

and a piston (5) slidable within the cylinder liner (4).

9. A pump according to claim 8 further comprising a ball-shaped valve element (16) located in seating relationship to said valve seat (15) and engageable with said valve seat during the suction stroke of the piston in the pump, the valve seat surrounding the outer end of the outlet duct (8) from the valve chamber (18).

10. A pump according to claim 9 wherein the housing structure defines a valve chamber (11), said valve chamber being essentially cylindrical;

and an adjustable abutment surface (17) located within the valve chamber and engageable by the valve ball (16) to permit adjustment of the stroke of the valve ball between open and closed position.

11. A pump according to claim 10 wherein the adjustment means for the stroke of the valve ball comprises an abutment bolt (17) extending through the housing structure into the valve chamber (11), the end face of the bolt (17) forming the abutment surface for the valve ball (16).

12. A pump according to claim 10 further comprising means (20, 21) connected to the piston (5) to control and adjust the stroke of the piston (5), whereby, by mutual adjustment of the stroke of the valve, and of the piston, the quantity of lead being supplied upon each stroke by the pump, as well as the flow conditions through the valve formed by the valve seat (15) and the valve ball (16) are controllable.

13. A pump according to claim 12 wherein the valve ball comprises a steel ball having a composition of approximately: 1.0% C, 0.25% Si, 0.35% Mn, a maximum of 0.03% P. 0.025% S and 1.55% Cr, remainder iron.

14. In the art of casting lead plate structures for lead batteries, the combination of a plate casting apparatus (P);

a reservoir of molten lead defining a molten lead level (L);

a pump immersed beneath the level of the molten lead in the reservoir and having an outlet line (12) connected to the plate casting apparatus (P)

wherein the pump comprises the pump of claim 1 the means (19) introducing molten lead into the pump chamber (18) being located below said level (L) of the molten lead.

15. In the art of casting lead structures, a method of making structural elements defining at least portions of a pump chamber of a pump to pump molten lead, said pump having a housing structure element (1, 4) defining at least a portion of a pump chamber (18);

means (19) introducing molten lead into the pump chamber;

and a pump element (5) located in the housing structure element (1, 4) forming a surface defining the pump chamber comprising the steps of high-pressure permanent mold casting said elements of a cast iron having a lamellar graphite structure;

nitriding said castings in a bath of molten cyanides and cyanates at a temperature of from 500° to 600° C. for a period of at least ½ hour;

and thereafter cooling said castings in air to room temperature.

* * * * *